US009809935B2

(12) United States Patent
Meincke et al.

(10) Patent No.: US 9,809,935 B2
(45) Date of Patent: Nov. 7, 2017

(54) RAIL OF A DRAINAGE CHANNEL

(71) Applicant: ACO SEVERIN AHLMANN GMBH & CO KOMMANDITGESELLSCHAFT, Büdelsdorf (DE)

(72) Inventors: Arne Meincke, Osdorf (DE); Jan Mieze, Hamburg (DE); Michael Sieber, Timmaspe (DE)

(73) Assignee: ACO SEVERIN AHLMANN GMBH & CO. KG, Budelsdorf (DE)

( * ) Notice: Subject to any disclaimer, the term of this patent is extended or adjusted under 35 U.S.C. 154(b) by 0 days.

(21) Appl. No.: 14/649,046

(22) PCT Filed: Dec. 4, 2013

(86) PCT No.: PCT/EP2013/075446
§ 371 (c)(1),
(2) Date: Jun. 2, 2015

(87) PCT Pub. No.: WO2014/086808
PCT Pub. Date: Jun. 12, 2014

(65) Prior Publication Data

US 2016/0194837 A1 Jul. 7, 2016

(30) Foreign Application Priority Data

Dec. 7, 2012 (DE) ..... 10 2012 111 960

(51) Int. Cl.
*E02D 29/14* (2006.01)
*E01C 11/22* (2006.01)
(Continued)

(52) U.S. Cl.
CPC ..... *E01C 11/227* (2013.01); *E02D 29/14* (2013.01); *E02D 29/149* (2013.01); *E03F 3/046* (2013.01); *E03F 5/06* (2013.01)

(58) Field of Classification Search
CPC ..... E02D 29/14
See application file for complete search history.

(56) References Cited

U.S. PATENT DOCUMENTS 1,040,442 A * 10/1912 Shannon ..... F16L 23/14 138/173
1,083,002 A * 12/1913 Charls ..... F16L 23/10 138/160

(Continued)

FOREIGN PATENT DOCUMENTS

DE 19620978 A1 1/1997
DE 20200509 U1 3/2002

(Continued)

OTHER PUBLICATIONS

International Search Report and Written Opinion issued in International Patent Application No. PCT/EP2013/075466; dated Jan. 27, 2014; English translation of ISR included.

(Continued)

*Primary Examiner* — Thomas B Will
*Assistant Examiner* — Katherine Chu
(74) *Attorney, Agent, or Firm* — Pearne & Gordon LLP

(57) ABSTRACT

Rails for drainage channels or manholes are known on which a cover of a channel or of a manhole can be placed. The rail has a horizontal bearing surface (10) extending in a longitudinal direction of the drainage channel or of the manhole and, substantially perpendicular to this bearing face, a rail edge (11) on the inner surface (12) of which the cover can be placed and on the outer surface (13) of which a surface covering can be applied. To increase the strength, it is proposed that the bearing surface (10) and/or the inner surface (12) and/or the outer surface (13) is/are provided with beads (20, 22, 23) over the entire length of the rail (1).

10 Claims, 1 Drawing Sheet

(51) Int. Cl.
*E03F 3/04* (2006.01)
*E03F 5/06* (2006.01)

(56) References Cited

U.S. PATENT DOCUMENTS

| | | | | | |
|---|---|---|---|---|---|
| 2,126,091 | A * | 8/1938 | Claybaugh | E01D 19/02 | 405/124 |
| 4,360,042 | A * | 11/1982 | Fouss | F16L 11/118 | 138/105 |
| 4,365,911 | A * | 12/1982 | Rossberg | E01C 11/227 | 404/2 |
| 4,498,804 | A * | 2/1985 | Ferns | E02D 29/14 | 404/25 |
| 4,592,674 | A * | 6/1986 | Baliva | B28B 21/563 | 277/615 |
| 4,637,752 | A * | 1/1987 | Centa | E02D 29/14 | 404/25 |
| 4,867,485 | A * | 9/1989 | Seckel | F16L 11/12 | 138/109 |
| 4,898,494 | A * | 2/1990 | Ellis | E02B 11/00 | 285/148.22 |
| 5,529,436 | A * | 6/1996 | Meyers | E01C 11/227 | 404/4 |
| 5,608,998 | A * | 3/1997 | Hume | E02D 29/12 | 405/150.1 |
| 5,735,638 | A * | 4/1998 | Beamer | E03F 3/046 | 404/4 |
| 6,524,722 | B2 * | 2/2003 | Schluter | F16L 9/06 | 428/603 |
| 7,470,085 | B1 * | 12/2008 | Suazo | E02B 5/02 | 405/119 |
| 8,439,602 | B1 * | 5/2013 | Suazo | E02B 5/02 | 405/118 |
| 2002/0094239 | A1 * | 7/2002 | Bradley | E02B 17/0026 | 405/216 |
| 2005/0100412 | A1 * | 5/2005 | Houck | E02B 11/005 | 405/124 |

FOREIGN PATENT DOCUMENTS

| | | | |
|---|---|---|---|
| DE | 202007016204 | U1 | 2/2008 |
| EP | 0447761 | A1 | 9/1991 |
| EP | 0707114 | A1 | 4/1996 |
| FR | 2520028 | A1 | 7/1983 |
| JP | H07-031991 | U | 6/1995 |
| JP | 2004225450 | A | 8/2004 |
| WO | WO9725481 | A1 | 7/1997 |
| WO | WO0058560 | A1 | 10/2000 |

OTHER PUBLICATIONS

The English translation of the Office Action issued in corresponding Japanese Patent Application No. 2015-545986, dated Oct. 4, 2016.

* cited by examiner

RAIL OF A DRAINAGE CHANNEL

The invention relates to a rail for a drainage channel or a manhole according to the preamble of patent claim 1.

To stabilize their upper edges, surface drainage channels or manholes are often provided with rails or edge-protection devices, which serve to receive cover rails for the channels or manholes. Since these rails play a not insignificant role in the load-bearing capacity of the channels or manholes, there is often a very high cost of materials.

In addition, there is the problem with such devices that, after long years of use, the gratings become stuck on the rails, so that it is no longer possible to lift the gratings.

Thus, on the whole, the object of the present invention is to improve upon a rail of the type defined in the introduction, so that a great stability is ensured, along with, at the same time, long-term usability with the least possible cost and effort.

This object is achieved by a rail according to patent claim 1.

This object is achieved in particular by a rail for a drainage channel or for a manhole, on which a cover for a channel and/or a manhole can be placed; this rail has a horizontal bearing surface running in a longitudinal direction of the drainage channel or the manhole and has a rail edge essentially perpendicular to the former, so that the cover can be placed on its inner surface and a surface covering can be attached to its outer surface, by providing beads over the entire length of the rail of the bearing face and/or the inner face and/or the outer face.

One essential idea of the present invention thus consists of the fact that an increased load capacity is achieved by a special shaping of the material of which the rail is produced. It is possible in this way to work with a weaker material, which, first of all, reduces the production cost of the overall arrangements (drainage channel/manhole) but, secondly, reduces the weight of the components, which is a major advantage in both shipping and installation.

The rail is preferably made of a steel plate material, in particular a steel plate material or a nonferrous plate material, for example, copper. The rail is preferably produced from a plate material in a thickness of 0.8 to 2 mm, preferably 1 to 1.5 mm. This relatively thin material has a surprisingly high strength due to the inventive shaping, thus saving on material and therefore costs and/or weight at the same time.

It is also possible to produce the rail from plastic because in this case the beads ensure an increased load-bearing capacity.

The beads in the inner faces preferably run parallel to the longitudinal direction of the channel and/or a main direction of the manhole. This yields an increased stiffness in this direction of particularly great stress.

The beads on the outer surfaces preferably run perpendicular to the longitudinal direction, i.e., vertically (after installation). An increased strength is therefore achieved in the transverse direction without any increase in the cost of materials.

The beads in the bearing surface may then run parallel to the longitudinal direction, i.e., just like the beads in the inner surface. An increased stiffness in the longitudinal direction is therefore achieved—as is the case with the beads on the inner faces.

The beads are preferably designed in an undulating shape, namely as hill-and-valley sections developing into one another as continuous wave trains. This shape thus provides the maximum bead density and therefore also the maximum stability.

Alternatively, the beads in the bearing surface may also be designed as an essentially continuous row of single beads. The stability of the bearing surfaces is not thereby increased substantially, but the connection between the rail and the channel body and/or manhole body is improved, so that sticking of the covers and/or gratings is effectively prevented at the same time.

In the region of the bearing surface, the rail has an interrupted section, which is preferably positioned centrally, as seen in the longitudinal direction, in particular in the case of extremely long rails for drainage channels, thus reducing the distortion of the arrangement when casting and shrinking the channel material and/or manhole material.

The beads are preferably designed by roll forming in particular in the design of the rails as plate material. By means of this method of production, the rails may be equipped with continuous lines of beads in the longitudinal direction, so that it is also possible to fold the plate material in a single shaping operation to form the bearing faces and the rail edge.

Exemplary embodiments of the present invention are explained in greater detail below on the basis of drawings, in which.

In the following description, the same reference numerals are used for the same parts and parts having the same effect.

Figure 1:
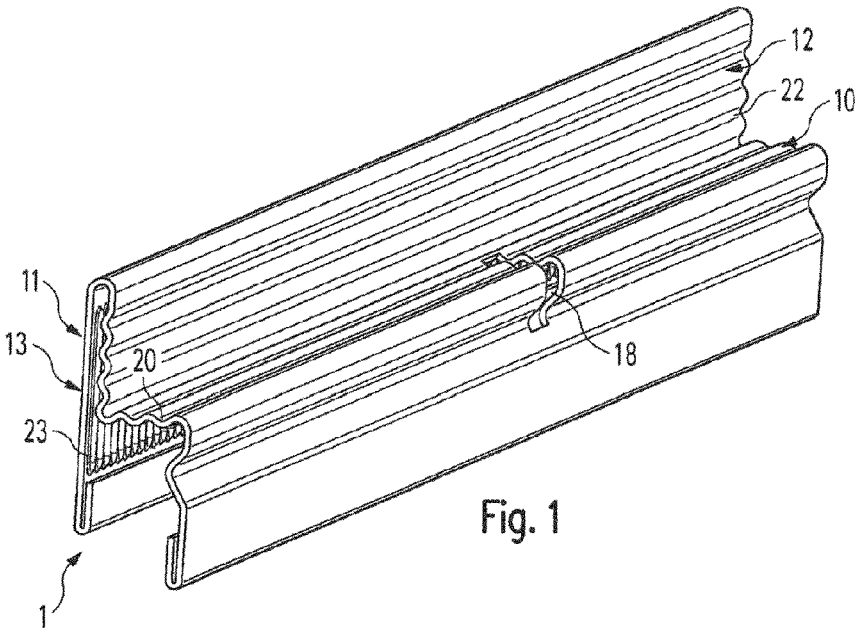
FIG. 1 shows a perspective diagram of a first embodiment of the invention.

As shown in FIG. 1, the rail 1 shown here comprises a bearing surface on which a channel cover or manhole cover, and/or manhole grating can be placed in the usual manner. A rail edge 11, whose inner face 12 forms a contact surface for the cover to prevent lateral displacement, is connected to this bearing surface 10. An outer surface 13 of the rail edge 11 forms a flush seal with the body of the channel or the manhole, not shown here. On installation, the surfacing is continued up to this outer face 13 and/or a corresponding surface covering is cast.

An inner section 15 extends downwards from the bearing surface 10, extending around the upper edge of the drainage channel (not shown here) and/or of the manhole together with the outer surface 13 of the rail edge 11. Both the lower edge of the outer surface 13 and the lower edge of the inner section 15 have an outer fold 14, and/or an inner fold 16, each being flanged inward in the direction of the upper edge of the channel and/or manhole. The inner fold 16 is also provided with an inner notch 17, which is provided for engaging locking devices for a cover.

Figure 2:
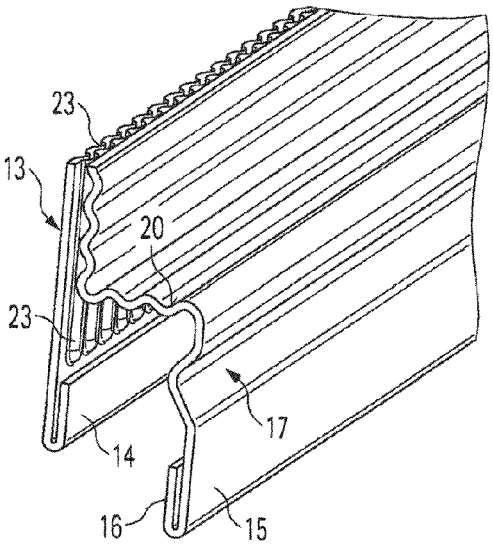
FIG. 2 shows the embodiment of the invention according to FIG. 1, wherein the rail edge has been cut transversely.

With the embodiment of the invention illustrated in FIGS. 1 and 2, the bearing surface 10 is now equipped with continuous bearing beads 20 extending over the entire length of the rail 1.

The shaping of the bearing beads 20 is designed so that a continuous wave pattern is formed in cross section. This yields, first of all, a substantial stiffening of the bearing surface with respect to bending perpendicular to the longitudinal direction, and on the other hand, yields a bearing surface for the cover, which establishes material contact in only a few linear regions. This ensures that sticking in this region is essentially impossible.

In all the embodiments shown here, the bearing surface of the rail edge 11 is provided with outer surface beads 23 running perpendicularly over a substantial portion of this outer surface 13. Here again, the structure is undulating (see FIG. 2 in particular), such that the hills and valleys are essentially directly adjacent to and develop into one another. FIG. 2 also shows that the height of the outer surface beads 23 extends to just in front of the upper edge of the rail edge 11 and below the bearing surface 10, so that an increased flexural stiffness is achieved with forces acting transversely to the longitudinal direction of the rail 11. Furthermore, adhesion between the rail and a cast surface covering is improved by these outer surface beads 23.

Figure 3:
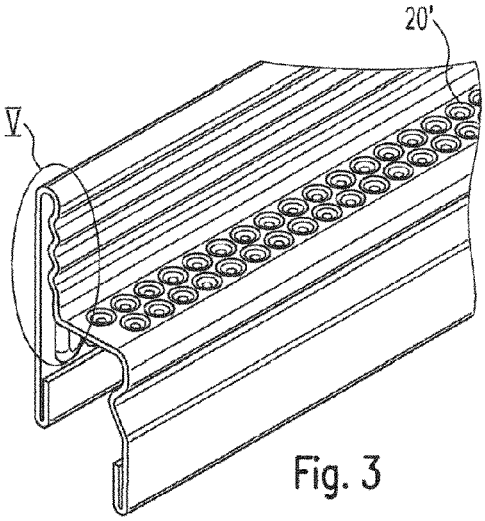
FIG. 3 shows another embodiment of the invention in a diagram like that according to FIG. 1.
Figure 4:
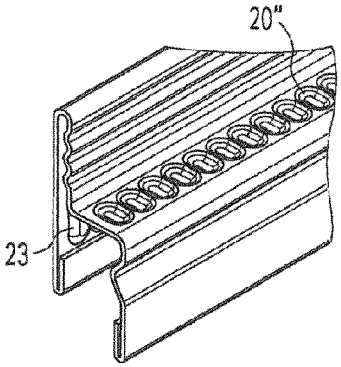
FIG. 4 shows another embodiment of the invention in a diagram like that according to FIG. 3.

The embodiments in FIGS. 3 and 4 differ from those according to FIGS. 1 and 2 in that the bearing beads are designed as circular embossings 20' (see FIG. 3) or, rather, as oval bearing beads 20" (see FIG. 4). The contact surface between the bearing surface 10 and an applied cover is increased in size, and nevertheless, sticking of the cover to the bearing face 10 is effectively prevented. The adhesion between the rail and/or the region of the bearing surface 10 and the cast channel body, and/or manhole body is improved.

Figure 5:
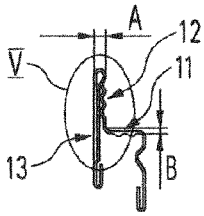
FIG. 5 shows a top view of the region V in FIG. 3.

Due to the design of the beads 20, 20', 20" shown here, as well as 22 and 23, the dimensions A and B of the rail 1, which are shown in FIG. 5, may be set essentially at will, so that predefined dimensions based on standards can be set independently of the thickness of material of which the rail 1 is produced.

In addition, it must be pointed out that production of the rail 1 from plate material can be accomplished in a particularly simple and nevertheless precise manner by roll forming. The beads 20 and 22 here are formed continuously, while the outer surface beads 23 and the bearing beads 20' and 20" (see FIGS. 3 and 4) are formed in the same procedure as "individual" embossings. Therefore, the rails 1 may be formed continuously from plate strip material.

| List of Reference Numerals | |
|---|---|
| 1 | Rail |
| 10 | Bearing surface |
| 11 | Rail edge |
| 12 | Inner surface |
| 13 | Outer surface |
| 14 | Outer fold |
| 15 | Inner section |
| 16 | Inner fold |
| 17 | Inner notch |
| 18 | Interrupting section |
| 20, 20', 20" | Bearing bead |
| 22 | Inner surface bead |
| 23 | Outer surface bead |

The invention claimed is:

1. A rail for a drainage channel or a manhole on which a cover for a channel and/or a manhole can be placed, having a horizontal bearing surface running in a longitudinal direction of the drainage channel or the manhole and having a rail edge essentially perpendicular to the former, wherein the cover can be placed on an inner surface of the rail or the rail edge, and a surface covering can be applied to an outer surface of the rail, characterized in that the outer surface is provided with beads over the entire length of the rail that run perpendicular to the longitudinal direction and thus vertically, and the inner surface is provided with beads that run parallel to the longitudinal direction.

2. The rail according to claim 1, characterized in that the rail is produced from a steel plate material.

3. The rail according to claim 1, characterized in that the bearing surface is provided with beads that run parallel to the longitudinal direction.

4. The rail according to claim 1, characterized in that the beads are designed to develop into one another in an undulating shape.

5. The rail according to one of claim 1, characterized in that the beads in the bearing surface are designed as an essentially continuous row of single beads.

6. The rail according to claim 1, characterized in that the rail has at least one interrupted section in the region of the bearing surface positioned centrally in the longitudinal direction.

7. The rail according to claim 2, characterized in that the beads are formed by roll forming.

8. The rail according to claim 2, characterized in that the rail is produced from a steel plate material having a thickness of 0.8 to 2 mm.

9. The rail according to claim 8, characterized in that the rail is produced from a steel plate material having a thickness of 1 to 1.5 mm.

10. The rail according to claim 4, characterized in that the beads are designed as hill-and-valley sections in the form of a continuous wave train.

* * * * *